US008920110B2

(12) United States Patent
Anguisola McFeat et al.

(10) Patent No.: US 8,920,110 B2
(45) Date of Patent: Dec. 30, 2014

(54) GAS TURBINE VANE WITH IMPROVED COOLING

(75) Inventors: Jose Anguisola McFeat, Lauchringen (DE); Erich Kreiselmaier, Stetten (CH); Christoph Nagler, Zurich (CH); Sergei Riazantsev, Stetten (CH)

(73) Assignee: Alstom Technology Ltd., Baden (CH)

( * ) Notice: Subject to any disclaimer, the term of this patent is extended or adjusted under 35 U.S.C. 154(b) by 527 days.

(21) Appl. No.: 12/783,046

(22) Filed: May 19, 2010

(65) Prior Publication Data

US 2011/0008177 A1 Jan. 13, 2011

(30) Foreign Application Priority Data

May 19, 2009 (EP) ..... 09160581

(51) Int. Cl.
*F01D 5/18* (2006.01)
*F01D 9/02* (2006.01)

(52) U.S. Cl.
CPC ..... *F01D 5/186* (2013.01); *F01D 5/188* (2013.01); *F01D 9/02* (2013.01); *F05D 2260/201* (2013.01); *F05D 2240/81* (2013.01)
USPC ..... 415/115

(58) Field of Classification Search
USPC .... 415/115, 116; 416/97 R, 97 A, 96 R, 96 A
See application file for complete search history.

(56) References Cited

U.S. PATENT DOCUMENTS

| | | | | |
|---|---|---|---|---|
| 3,807,892 | A | 4/1974 | Frei et al. | |
| 5,711,650 | A | 1/1998 | Tibbott et al. | |
| 6,183,192 | B1 * | 2/2001 | Tressler et al. | 415/115 |
| 6,517,312 | B1 * | 2/2003 | Jones et al. | 415/115 |
| 6,874,988 | B2 * | 4/2005 | Tiemann | 415/115 |
| 7,097,418 | B2 | 8/2006 | Trindade et al. | |
| 7,465,154 | B2 * | 12/2008 | Devore et al. | 416/97 R |
| 7,806,659 | B1 * | 10/2010 | Liang | 416/97 R |
| 2002/0090294 | A1 | 7/2002 | Keith et al. | |
| 2005/0226726 | A1 | 10/2005 | Lee et al. | |
| 2010/0247284 | A1 * | 9/2010 | Gregg et al. | 415/1 |
| 2010/0247327 | A1 * | 9/2010 | Malecki et al. | 416/96 A |

FOREIGN PATENT DOCUMENTS

| | | | |
|---|---|---|---|
| DE | 2202858 | B1 | 7/1973 |
| EP | 1136652 | A1 | 9/2001 |
| EP | 1221538 | A2 | 7/2002 |
| EP | 1584790 | A2 | 10/2005 |
| EP | 1221538 | B1 | 5/2006 |

OTHER PUBLICATIONS

European Search Report for EP 09160581.6 dated Nov. 4, 2009.

* cited by examiner

*Primary Examiner* — Nathaniel Wiehe
*Assistant Examiner* — Jeffrey A Brownson
(74) *Attorney, Agent, or Firm* — Buchanan Ingersoll & Rooney PC

(57) ABSTRACT

The disclosure relates to a hollow gas turbine vane that is cooled by an arrangement configured to sequential cooling an endwall of the vane and its airfoil and, at the same time, the two endwalls of the vane. This arrangement can reduce cooling air demand, which can have a positive effect on the turbines efficiency.

20 Claims, 4 Drawing Sheets

GAS TURBINE VANE WITH IMPROVED COOLING

RELATED APPLICATIONS

This application claims priority under 35 U.S.C. §119 to European Patent Application No. 09160581.6 filed in Europe on May 19, 2009, the entire content of which is hereby incorporated by reference in its entirety.

FIELD

The disclosure relates generally to gas turbine vanes and to cooling configurations thereof.

For the purposes of this specification the term sequential cooling refers to cooling in sequence without a supplementary addition of cooling fluid and includes arrangements where cooling flow can be divided and subsequently recombined for use in further cooling.

BACKGROUND INFORMATION

The output rate of a gas turbine can be a strong function of inlet temperature. However, how hot a gas turbine can be operated at can be limited by metallurgical constraints of the turbine parts and the cooling effectiveness of those parts. To keep parts cool and therefore maximise output, cooling air drawn from the gas turbine compressor can be used to cool parts. This draw-off, however, can represent a direct loss in gas turbine efficiency. It can be desirable to minimise the draw-off by, for example, ensuring optimal use of the cooling air.

A large number of cooling designs have been developed with the objective of providing effective cooling. Known designs use a variety of convection cooling designs including cooling augmentation features and film cooling schemes with impingement cooling arrangements. Convective cooling arrangements additionally may also include cooling augmentation features, which are features that can improve cooling effectiveness by increasing wall surface area and/or creating wall turbulence. Examples of cooling augmentation features can include pins projected from the inside walls of the of the vane, ribs positioned obtusely to the cooling air flow and pedestals, which are a form of pin, projected across the gap between vane pressure side and suction side walls.

An example of a cooling arrangement is provided in U.S. Pat. No. 7,097,418 which discloses an airfoil impingement cooling arrangement. EP 1 221 538 B1 discloses another arrangement that includes an airfoil impingement cooling system utilising impingement tubes contained and partitioned within a plurality of cavities of the airfoil. Further disclosed are chordwise ribs used to direct cooling medium flow in the chordwise direction within these cavities. The foregoing documents are incorporated herein by reference in their entireties.

SUMMARY

A hollow gas turbine vane is disclosed comprising: a first endwall including a first endwall cooling passage configured to receive cooling air for cooling the first endwall; an airfoil, extending radially from the first endwall, including opposite pressure and suction side walls extending chordwise between a leading edge and a trailing edge of the airfoil, and including an airfoil cooling passage radially extending between radial ends of the airfoil, configured by connection, to receive cooling air from the first endwall cooling passage; a second endwall at an airfoil end radially distal from the first endwall, having a second endwall cooling passage connected to the airfoil cooling passage to be in cooling air communication with the airfoil cooling passage, wherein the airfoil cooling passage extends from the first endwall cooling passage to the second endwall cooling passage and is configured by direct connection for exclusively receiving cooling air used to cool the first endwall; and a wall cooling passage of the airfoil extending from a region of the leading edge to the trailing edge and being configured, in the leading edge region, for receiving cooling air exclusively from the airfoil cooling passage and, at the trailing edge for ejecting cooling air therethrough such that cooling air in the wall cooling passage sequentially cools the airfoil from the leading edge to the trailing edge, wherein the second endwall cooling passage is configured by direct connection to the airfoil cooling passage so that cooling air for cooling of the second endwall will be exclusively received from the airfoil cooling passage.

BRIEF DESCRIPTION OF THE DRAWINGS

By way of example, exemplary embodiments of the present disclosure are described more fully hereinafter with reference to the accompanying drawings, in which.

Figure 1:
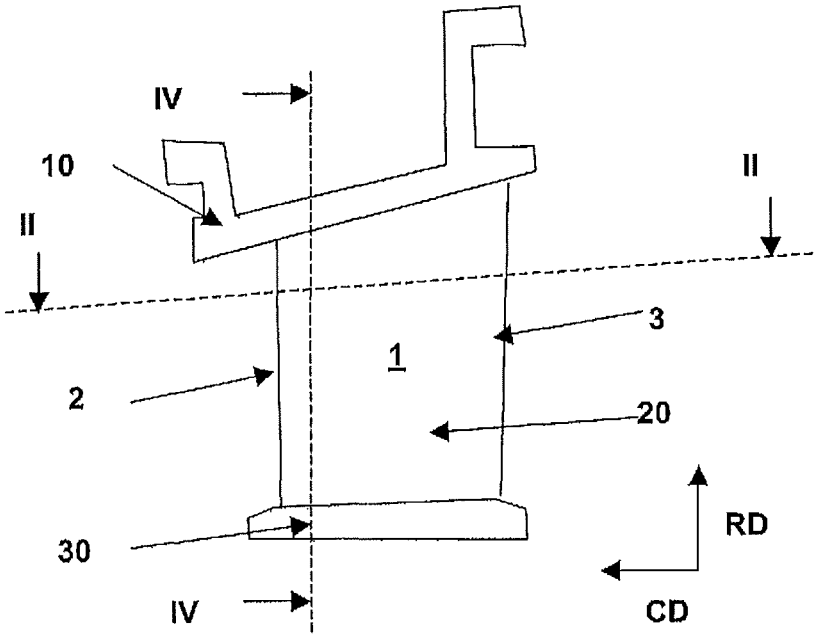
FIG. 1 is a schematic view of a gas turbine vane according to an exemplary embodiment of the disclosure.

Exemplary embodiments of the present disclosure are now described with reference to the drawings, wherein like reference numerals are used to refer to like elements throughout. In the following description, for purposes of explanation, numerous specific details are set forth in order to provide a thorough understanding of the disclosure. It may be evident, however, that the disclosure may be practiced without these specific details. In other instances, well-known structures and devices are shown in block diagram form in order to facilitate description of the disclosure.

DETAILED DESCRIPTION

Exemplary embodiments are disclosed which can address cooling air demand for cooling of vanes and the detrimental effect this demand can have on gas turbine efficiency.

Exemplary embodiments disclosed herein can improve the utilisation of a cooling medium with alternate and/or improved designs.

For example, sequential cooling is provided for an endwall of the vane and its airfoil and, at the same time, the two endwalls of the vane. This arrangement has been calculated to reduce cooling air demand by up to 20% (or greater) wherein the actual benefit is dependent on, for example, design and operational factors.

An exemplary embodiment provides a hollow gas turbine vane including a first endwall having a first endwall cooling passage configured to receive cooling air for cooling the first endwall. An airfoil extends radially from the first endwall and includes opposing pressure and suction side walls extending chordwise between a leading edge and a trailing edge. The airfoil has an airfoil cooling passage that radially extends between radial ends of the airfoil and can be configured to receive cooling air from the first endwall cooling passage. The vane includes a second endwall, at an airfoil end radially distal from the first endwall that has a second endwall cooling passage configured to receive cooling air from the airfoil cooling passage. The exemplary gas turbine vane includes:

the airfoil cooling passage extending from the first endwall cooling passage to the second endwall cooling passage configured by direct connection to exclusively receive cooling air used to cool the first endwall;

the airfoil including a wall cooling passage extending from a region of the leading edge to the trailing edge configured, in the leading edge region (A), to receive cooling air exclusively from the cooling passage, and at the trailing edge to eject cooling air therethrough, the configuration being such that cooling air in the wall cooling passage sequentially cools, from the leading edge to the trailing edge, the airfoil; and the second endwall cooling passage configured by direct connection to the airfoil cooling passage so that cooling air for cooling of the second endwall can be exclusively received from the airfoil cooling passage.

In an exemplary embodiment the vane can include a hollow impingement tube located in the airfoil wherein the hollow of the impingement tube forms the airfoil cooling passage. The impingement tube can also extend chordwise from the leading edge through a mid-chord region to a region adjacent to the trailing edge and be spaced from the pressure side wall and the suction side wall. The space between the impingement tube and the side walls, in an embodiment, splits the wall cooling passage in this the regions into a pressure side wall cooling passage and a suction side wall cooling passage respectively. In addition, the impingement tube can be configured for impingement cooling only of a leading edge region extending chordwise between the leading ledge and the mid chord region.

Another exemplary embodiment provides the vane with the pressure side wall and the suction side wall, in the mid chord region, with cooling augmentation features. The cooling augmentation features in a region of the mid chord region adjacent the trailing edge region can be configured to provide enhanced cooling augmentation compared to the cooling augmentation features adjacent the leading edge region. This may be achieved, in an aspect, by the closer spacing of the cooling augmentation features in the region of the mid chord region adjacent the trailing edge region.

Another exemplary embodiment of the vane provides a configuration of the side wall cooling passages such that they have different flow resistances relative to each other. The difference can also be disproportionate to the in use relative heat loads of the side wall cooling passages in the vicinity of the mid-chord region. In an arrangement shown to provide reduced cooling air demand, the cooling air flow split between the suction side wall cooling passage and the pressure side wall cooling passage is between 65:35 and 75:25. In an exemplary embodiment, the relative flow resistance to cooling air may be a function of the spacing of the impingement tube from the side walls wherein, for example, the space can be defined by the extension of the cooling augmentation features, which, for example, can be pins, from each of the side walls respectively.

In an exemplary embodiment the suction side wall cooling passage and the pressure side wall cooling passage can join to form a trailing edge wall cooling passage in the trailing edge region. For example, the trailing edge region can include chordwise extending ribs for directing cooling air in a chordwise direction.

FIG. 1 shows a vane 1 of a gas turbine to which an exemplary embodiment of the disclosure can be applied. The vane 1 includes a first endwall 10 for supporting the vane 1 onto a stator. Extending radially RD from the first endwall 10 is an airfoil 20 with a leading edge 2 and a trailing edge 3 that are distal from each other in the chordwise direction CD. Forming a radial RD end of airfoil 20, radially distal from the first endwall 10, is a second endwall 30.

Figure 2:
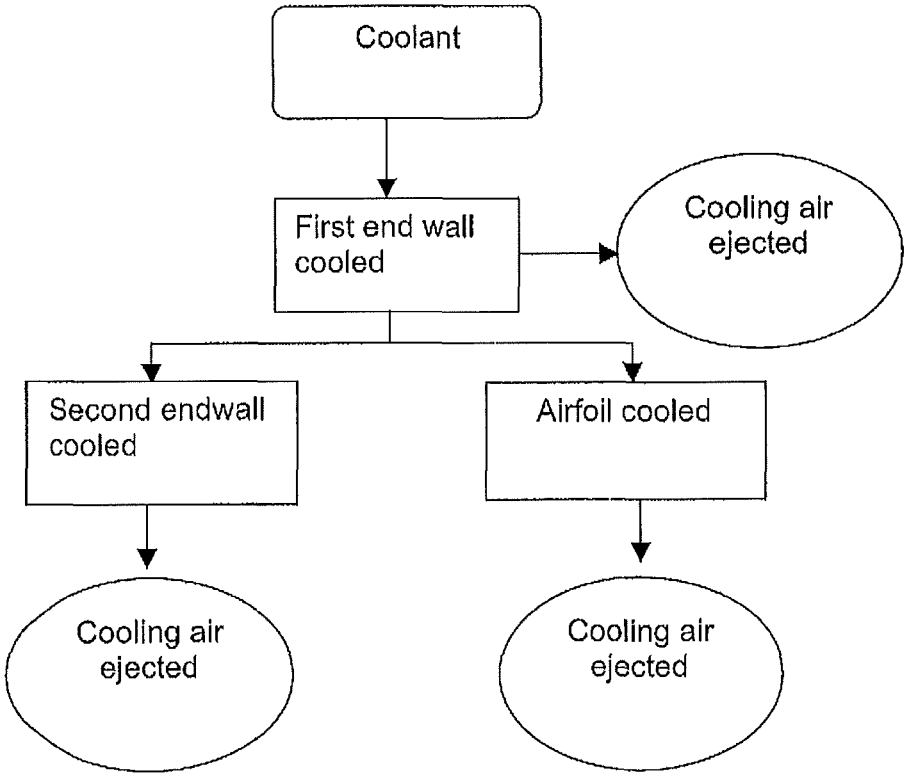
FIG. 2 is a block diagram showing vane cooling passage connections of an exemplary embodiment applied to the vane of FIG. 1.

FIG. 2 is a flow diagram showing an exemplary embodiment of the disclosure in its simplest form. The cooling arrangement in this embodiment includes the vane 1 of FIG. 1 wherein the vane 1 can be configured such that in use, cooling air, which first cools the first endwall 10, can be segregated into a portion that sequentially cools the airfoil 20 and another portion that sequentially cools the second endwall 30. The first endwall 10 may optionally be configured to ejected a portion of cooling air, as may the airfoil 20 and second endwall 30.

Figure 3:
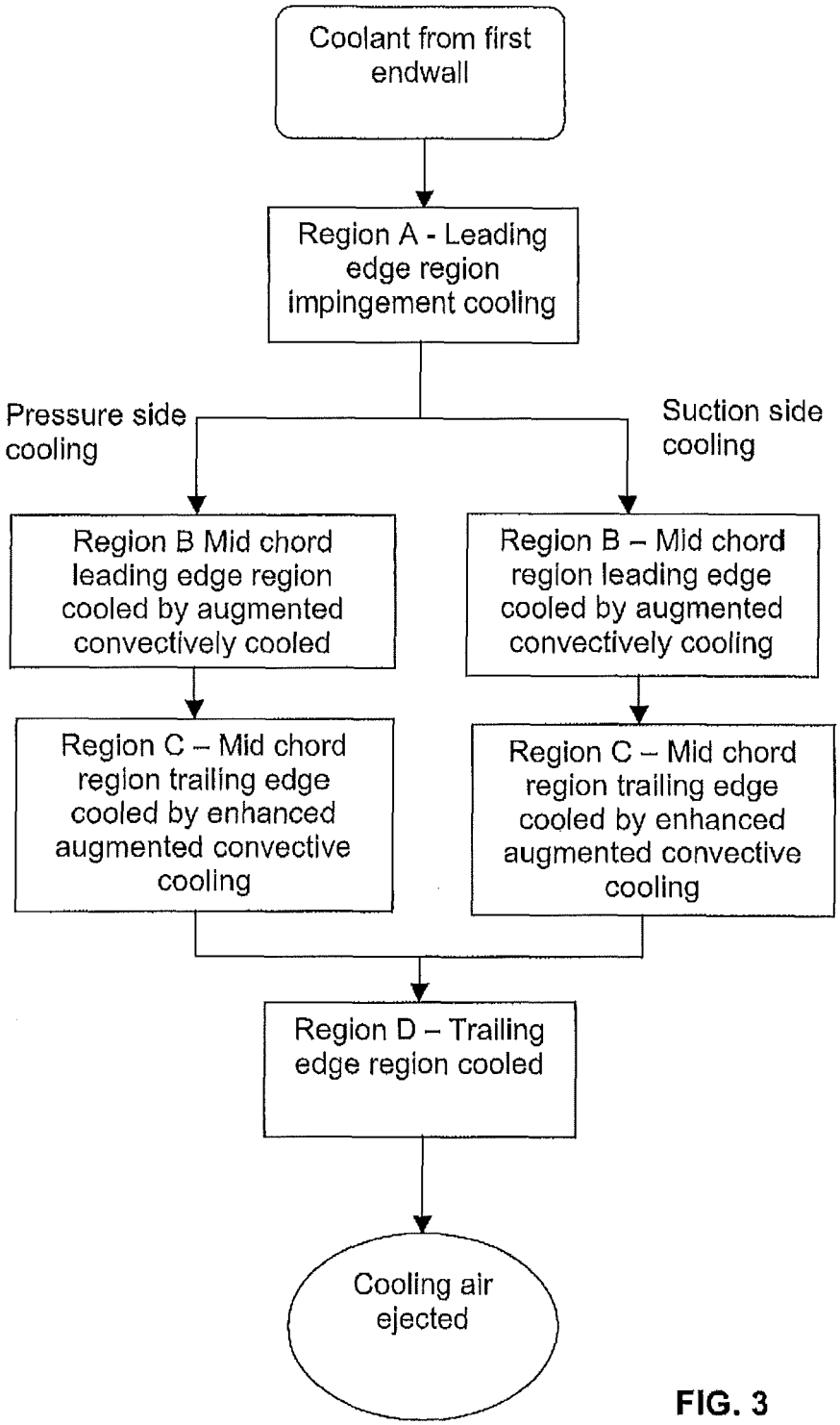
FIG. 3 is a block diagram showing airfoil cooling passage connections of an exemplary embodiment applied to the vane of FIG. 1.
Figure 4:
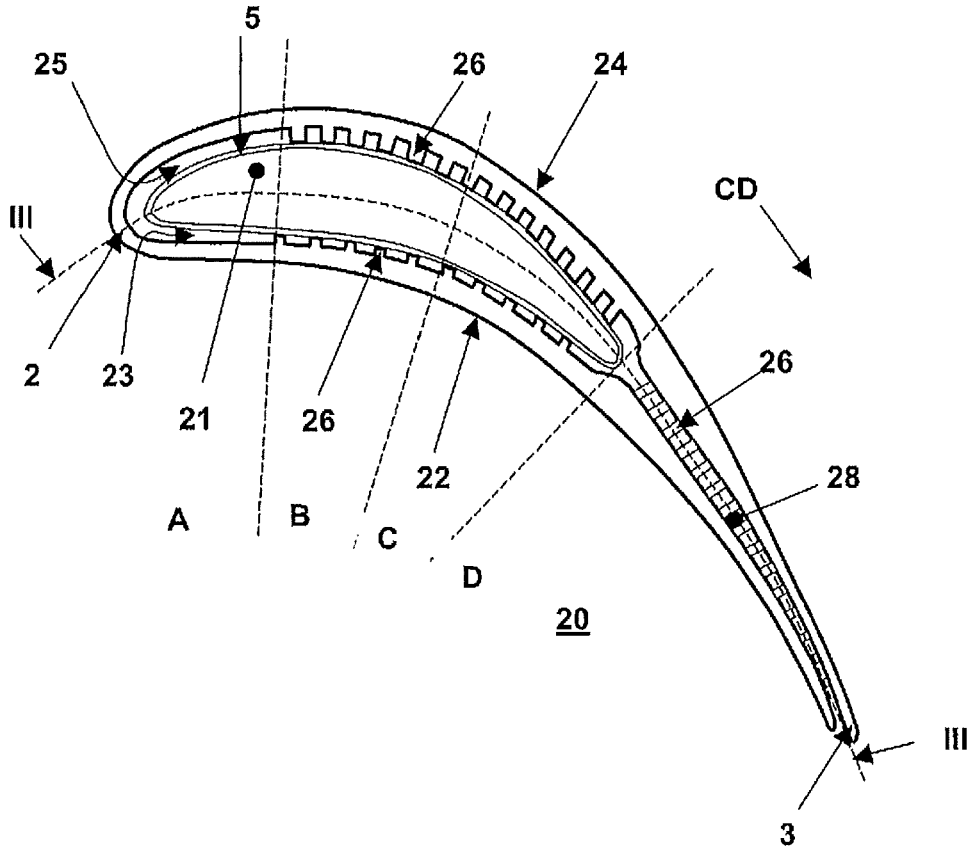
FIG. 4 is a sectional view through II-II in FIG. 1 showing an exemplary internal arrangement of the airfoil section of the vane.

FIG. 3 is a flow diagram detailing the sequential flow of cooling air through an exemplary embodiment of the airfoil 20 shown in FIG. 1. The airfoil 20 is configured to be cooled by cooling air first used to cool the first endwall 10. From the first endwall 10 cooling air first flows into the leading edge region A, which is the region extending between the leading edge 2 and mid-chord region B-C, as shown in FIG. 4. This region A can be configured for impingement cooling. The cooling air used for the impingement cooling can then be directed, by configuration of the airfoil 10, from the leading edge region A via pressure 23 and suction side wall cooling passages 25 (see FIG. 4) into the mid-chord region B-C where it provides augmented convective cooling of the airfoil side walls 22, 24 with the aid of cooling augmentation features shown in FIG. 4. In the mid-chord region adjacent the trailing edge C, the cooling augmentation features can be configured as enhanced, relative to region B, cooling augmentation features. This configuration can provide improved utilisation of cooling air, compensating for the heating, and therefore loss of heat transfer driving force, of the cooling air as it passes the mid-chord region adjacent the leading edge B. Cooling air from the side wall cooling passages 23,25 then join and mix into a single trailing edge wall cooling passage 28 located between the trailing edge 3 and the mid-chord region B-C, in a region that defines the trailing edge region D, as shown in FIG. 4. From the trailing edge wall cooling passage 28 cooling air can be ejected from the vane 1 through the trailing edge 3.

FIG. 4 shows an exemplary embodiment of an airfoil 20 having features configured to achieve the cooling air flow arrangement shown in FIGS. 2 and 3. In the exemplary embodiment, an impingement tube 5 can be contained within the hollow airfoil 20 and extends into the leading edge region A and mid-chord region B-C. In these regions A-C the tube 5 forms a suction side wall cooling passage 25 and a pressure side wall cooling passage 23 between it and the respective pressure side wall 22 and suction side wall 24. In the leading edge region A the impingement tube 5 has holes (not shown) that enables cooling air from the airfoil cooling passage 21 to pass through walls of the impingement tube 5, so by impingement cooling this region A.

Figure 5:
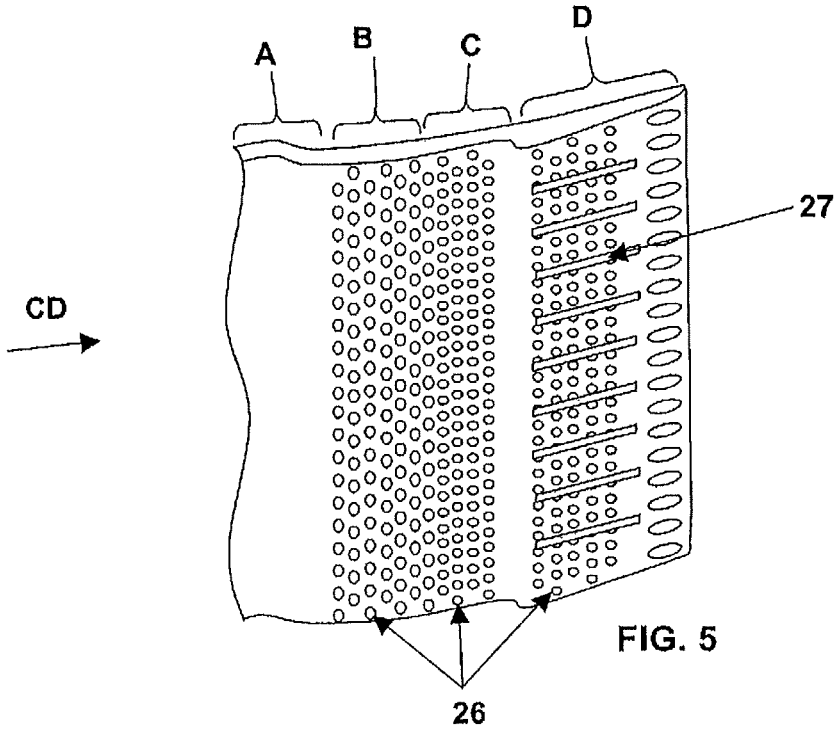
FIG. 5 is a sectional view through III-III in FIG. 4 showing an exemplary wall arrangement of the airfoil with the impingement tube removed.
Figure 6:
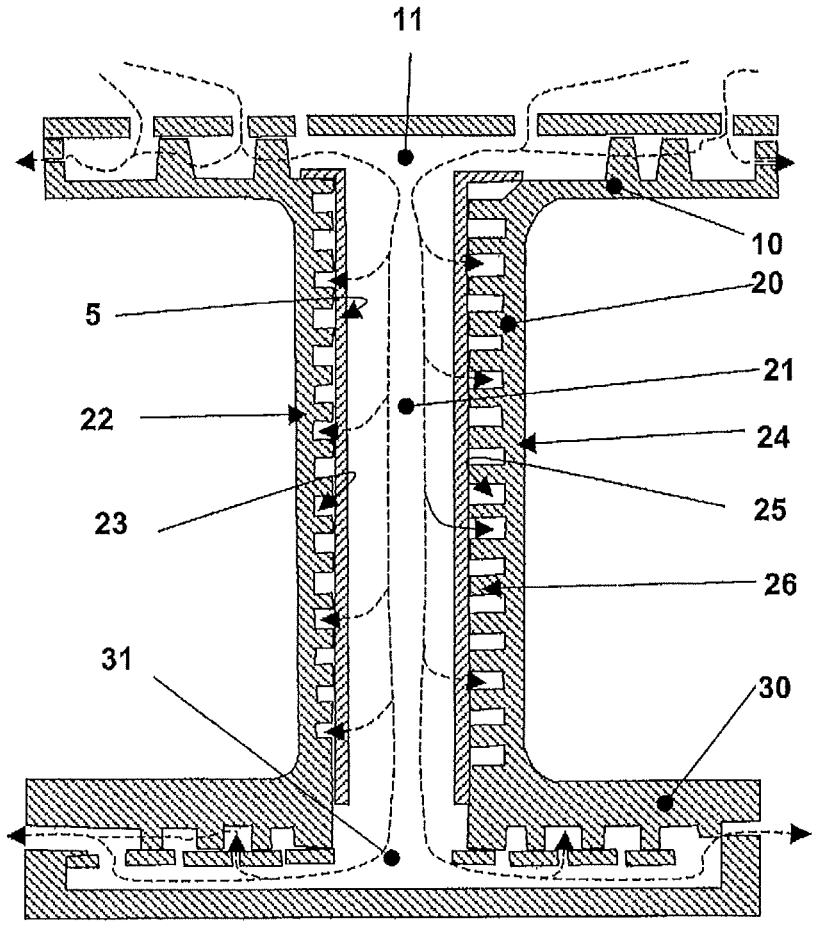
FIG. 6 is a sectional view through IV-IV in FIG. 1 showing an exemplary arrangement of the vane.

Contained within the side wall cooling passages 23,25 are cooling augmentation features that improve cooling effectiveness. The cooling augmentation features may be pins 26, as shown in FIGS. 4 to 6, radially aligned ribs, turbulators or other known features that provide improved cooling effectiveness by increasing surface area and/or promote mixing.

In region B-C, cooling air can be configured to flow in the chordwise direction CD towards the trailing edge 3 across the cooling augmentation features. As the temperature of the cooling air increases, the temperature gradient between the cooling medium and the side walls 22,24 can be reduced. To counteract this affect, the cooling augmentation features in the mid-chord region adjacent the trailing edge C can be enhanced to provide greater cooling augmentation than the cooling augmentation features in the mid-chord region adjacent the leading edge B. When the cooling augmentation features are pins 26, this can be achieved by the reduction of pin size, increasing pin number and/or closer spacing of the pins 26, as shown in FIGS. 4 and 5. The cooling augmentation feature configuration may also be changed in other ways and still achieve the same enhanced cooling augmentation by, for example, differently configuring, shaping and/or sizing the cooling augmentation features.

The pressure side wall cooling passage 23 and the suction side wall cooling passage 25 can be configured to ensure that, for example, different cooling air flowrates pass through each passage 23,25 so that in an exemplary embodiment, the flowrates compensate for the different heat loads between the two sides of the airfoil. In the exemplary embodiment shown in FIG. 4, where the airfoil 20 is sequentially cooled from the leading edge 2 to the trailing edge 3, the side wall cooling passages 23,25 can be configured to disproportionately distribute cooling flow through each of the side wall cooling passages 23,25 relative to the relative heat load of each of the side walls 22,24 in the mid-chord region B-C. In the exemplary embodiment of FIG. 4 and FIG. 6, this can be achieved by increasing the size of the suction side wall cooling passage 25, relative to that of the pressure side wall cooling passage 23, by extending the pins 26 further from the side wall 24. This can have the effect of reducing flow resistance of through flowing cooling air causing preferential cooling air flow through the suction side wall cooling passage 25. Changing of flow resistance is known where the exemplary embodiment is but one method of achieving the desired result. Other known non-exemplified alternatives could equally be applied separately or in conjunction with the exemplified arrangement, including changing of the configuration of the cooling augmentation features. In an exemplary embodiment the resulting cooling air distributed between the suction side 25 and pressure side wall cooling passages 23 can be in the ratio of between 65:35 and 75:25.

The resulting effect of having cooling flows through the side wall cooling passages 23,25 disproportionately to the relative heat load is that the overall cooling effectiveness in the mid-chord region B-C can be reduced and the exit temperature of cooling air from each of the side wall cooling passages 23,25 is not the same. The benefit of this can be realised in the cooling of the trailing edge region D.

As shown in FIG. 4 the airfoil can be configured so that the cooling air from the side wall cooling passages 23,25, mixes, combines and then flows into a single trailing edge wall cooling passage 28 extending through the trailing edge region D. Within the trailing edge wall cooling passage 28 cooling augmentation features, such as pins 26 that extend from the suction side wall 24 to the pressure side wall 22 to form pedestals, may be provided. As shown in FIG. 5 the trailing edge region D may also include substantially chordwise aligned ribs 27 for directing cooling air in the chordwise direction CD.

The trailing edge region D can be a relatively highly stressed region, and it is therefore desirable to provide effective cooling of this region D. One way to achieve this can be to increase the cooling air rate in this region. However, in a sequential cooling arrangement of the exemplary embodiments this may not be possible. An alternative includes reducing cooling effectiveness in the mid-chord region B-C. As a result of reduced cooling effectiveness in the mid-chord region B-C, cooling air temperature supplied to the trailing edge region D is lowered, thus increasing the cooling air temperature driving force so by enabling the cooling air in the trailing edge region D to remove more heat and so effect an increase in cooling effectiveness in this region D without the need to provide supplementary cooling air. The overall result is that the features of the exemplary embodiment shown in FIG. 4 enable effective sequential cooling of the airfoil 20 by the adjustment of cooling effectiveness rather than region specific flow rate in order to balance heat loads and the relative cooling criticality of the leading edge A, mid chord B-C and trailing edge D regions.

FIG. 5 shows a section of the suction side wall 24, according to an exemplary embodiment, extending from the leading edge 2 to the trailing edge 3, wherein various regions of the wall are shown, including:

- a leading edge region A, configured for impingement cooling by being smooth walled;
- a mid-chord region adjacent the leading edge region B configured with cooling augmentation features that are pins 26;
- a mid-chord region adjacent the trailing edge region C configured with enhanced cooling augmentation features that are smaller, have a greater distribution density, and are greater in number that the pins 26 of region B; and
- a trailing edge region D configured with cooling augmentation features in the form of pins 26 that, as shown in FIG. 4, extend between the suction side wall 24 and pressure side wall 22, and ribs 27 that extend substantially chordwise so as to direct cooling air flow in the chordwise direction CD.

FIG. 6, which is a radial direction RD cross sectional view through the leading edge region A of the vane 1 of FIG. 1, shows an exemplary sequential cooling arrangement of a vane 1. A first endwall cooling passage 11 can be directly connected to the airfoil cooling passage 21 such that the airfoil cooling passage 21 can be exclusively provided with cooling air used to cool the first endwall 10. The airfoil cooling passage 21, formed by the inner cavity of an impingement tube 5, has holes that enable impingement cooling of the side walls 22,24 in the leading edge region A. Pins 26, in the mid-chord region B-C, shown in FIG. 4, extend from the side walls 22,24 and space the impingement tube 5 from the side walls 22,24 so by forming pressure side 23 and suction side 25 wall cooling passages respectively through which cooling air, used to impingement cool the leading edge region A, can flow. In this way the first endwall 10 and airfoil 20 may be sequentially cooled.

The airfoil cooling passage 21 can be further directly connected, at an end radially distal from the first endwall 10, to a second endwall cooling passage 31. The connection enables sequential cooling of the first endwall 10 and the second endwall 30. Directly connected, in the context of this specification means without intermediate.

This arrangement of sequential cooling combined with the features shown in FIGS. 4, 5 and 6 has been estimated in one vane configuration to reduce cooling air demand by up to 20% (or greater). The actual cooling air demand reduction and the applicability of the exemplary embodiments can be however dependent on a multitude of factors including vane design a, material the vane is made of, the availability of cooling air and the vane's operating conditions.

Although the disclosure has been herein shown and described in what is conceived to be the most practical exemplary embodiments, it will be appreciated by those skilled in the art that the present disclosure can be embodied in other specific forms without departing from the spirit or essential characteristics thereof. The presently disclosed embodiments are therefore considered in all respects to be illustrative and not restricted.

REFERENCE NUMBERS

1 Vane
2 Leading edge
3 Trailing edge
5 Impingement Tube
10 First endwall
11 First endwall cooling passage
20 Airfoil
21 Airfoil cooling passage
22 Pressure side wall
23 Pressure side wall cooling passage
24 Suction side wall
25 Suction side wall cooling passage
26 Pins
27 Ribs
28 Trailing edge wall cooling passage
30 Second endwall
31 Second endwall cooling passage
A Leading edge region
B-C Mid chord regions
D Trailing edge region
CD Chordwise direction
RD Radial direction

What is claimed is:

1. A hollow gas turbine vane comprising:

a hollow first endwall including a first endwall cooling passage configured to receive cooling air for cooling the first endwall, the first endwall cooling passage arranged in an interior of the hollow first endwall defined by spaced apart walls having spacers formed there between;

an airfoil, extending radially from the first endwall, including opposite pressure and suction side walls extending chordwise between a leading edge and a trailing edge of the airfoil, and including an airfoil cooling passage radially extending between radial ends of the airfoil, configured by connection, to receive cooling air from the first endwall cooling passage;

a second endwall at an airfoil end radially distal from the first endwall, having a second endwall cooling passage connected to the airfoil cooling passage to be in cooling air communication with the airfoil cooling passage, wherein the airfoil cooling passage extends from the first endwall cooling passage to the second endwall cooling passage and is configured by direct connection for exclusively receiving cooling air used to cool the first endwall; and a wall cooling passage of the airfoil extending from a region of the leading edge to the trailing edge and being configured, in the leading edge region, for receiving cooling air exclusively from the airfoil cooling passage and, at the trailing edge for ejecting cooling air therethrough such that cooling air in the wall cooling passage sequentially cools the airfoil from the leading edge to the trailing edge, wherein the second endwall cooling passage is configured by direct connection to the airfoil cooling passage so that the second endwall is cooled exclusively by cooling air received from the airfoil cooling passage, that cooling air having been exclusively used to cool the first endwall via the first endwall cooling passage prior to entering the airfoil cooling passage.

2. The vane of claim 1, comprising:

a hollow impingement tube located in the airfoil, wherein a hollow portion of the impingement tube forms the airfoil cooling passage.

3. The vane of claim 2, wherein the impingement tube extends chordwise from the leading edge through a mid-chord region to a region adjacent to the trailing edge, and is spaced from the pressure side wall and the suction side wall wherein the space between the impingement tube and the side walls split the wall cooling passage in the regions into a pressure side wall cooling passage and a suction side wall cooling passage, respectively.

4. The vane of claim 3, wherein the impingement tube is configured for impingement cooling only of a leading edge region extending chordwise between the leading ledge and the mid-chord region.

5. The vane of claim 3, wherein the pressure side wall cooling passage and suction side wall cooling passage are configured for receiving cooling air exclusively from cooling air used to impingement cool the leading edge region.

6. The vane of claim 3, wherein the pressure side wall and suction side wall in the mid-chord region have cooling augmentation features.

7. The vane of claim 6, wherein the cooling augmentation features in a region of the mid-chord region adjacent the trailing edge region are configured to provide enhanced cooling augmentation compared to the cooling augmentation features adjacent the leading edge region.

8. The vane of claim 7, wherein the enhanced cooling augmentation is a result of closer spacing of the cooling augmentation features in the region of the mid-chord region adjacent the trailing edge region than in the mid-chord region adjacent the leading edge.

9. The vane of claim 8, wherein the side wall cooling passages are configured to provide different flow resistance relative to each other.

10. The vane of claim 9, wherein the side wall cooling passages are configured to provide a flow resistance to cooling air, relative to each other that is disproportionate to in use relative heat loads, in a vicinity of the mid-chord region of the side wall cooling passages.

11. The vane of claim 8, wherein a relative flow resistance in the side wall cooling passages to cooling air is such that, in use, cooling air flow split between the suction side wall cooling passage and the pressure side wall cooling passage is split in a ratio in a range of 65:35 and 75:25.

12. The vane of claim 9, wherein the relative flow resistance to cooling air is a function of spacing of the impingement tube from the side walls.

13. The vane of claim 12, wherein the spacing of the impingement tube from the side walls is defined by an extension of cooling augmentation features from each of the side walls, respectively.

14. The vane claim 6, wherein the cooling augmentation features are pins.

15. The vane of claim 3, wherein the suction side wall cooling passage and the pressure side wall cooling passage join to form a trailing edge wall cooling passage in the trailing edge region.

16. The vane of claim 15, wherein the trailing edge cooling passage comprises:

chordwise extending ribs for directing cooling air in a chordwise direction.

17. The vane of claim 4, wherein the pressure side wall cooling passage and suction side wall cooling passage are configured for receiving cooling air exclusively from cooling air used to impingement cool the leading edge region.

18. The vane of claim 4, wherein the pressure side wall and suction side wall in the mid-chord region have cooling augmentation features.

19. The vane of claim 5, wherein the pressure side wall and suction side wall in the mid-chord region have cooling augmentation features.

20. The vane of claim 9, wherein the relative flow resistance to cooling air is such that, in use, the cooling air flow split between the suction side wall cooling passage and the pressure side wall cooling passage is split in a ratio in a range of 65:35 and 75:25.

* * * * *